US006135932A

United States Patent [19]

Pittroff

[11] Patent Number: 6,135,932

[45] Date of Patent: Oct. 24, 2000

[54] METHOD AND DEVICE FOR DISTRIBUTING THE LOAD OF A WEIGHT LIFTING BARBELL DURING THE PERFORMANCE OF THE FRONT SQUAT EXERCISE

[76] Inventor: Mark D. Pittroff, 4081 Creek Rd., Cincinnati, Ohio 45241

[21] Appl. No.: 09/213,716

[22] Filed: Dec. 17, 1998

Related U.S. Application Data

[60] Provisional application No. 60/068,292, Dec. 19, 1997.

[51] Int. Cl.[7] ..... A63B 21/072

[52] U.S. Cl. ..... 482/106; 482/93

[58] Field of Search ..... 482/93, 105, 106, 482/108, 104

[56] References Cited

U.S. PATENT DOCUMENTS

| | | | |
|---|---|---|---|
| 3,500,472 | 3/1970 | Castellani . | |
| 3,679,107 | 7/1972 | Perrine | 224/5 |
| 4,213,605 | 7/1980 | McPeak . | |
| 5,058,886 | 10/1991 | Jackson | 482/93 |
| 5,211,615 | 5/1993 | Sides | 482/105 |
| 5,342,272 | 8/1994 | Pittroff | 482/106 |

OTHER PUBLICATIONS

Schwarzenegger, Arnold. *Encyclopedia of Modern Body–Building.* 1985 New York & Simon & Schuster. pp. 464, 470–471.

*Primary Examiner*—John Mulcahy

*Attorney, Agent, or Firm*—Mark F. Smith; Smith, Guttag & Bolin Ltd

[57] ABSTRACT

A method of performing the front squat exercise and a weight lifting device for distributing the load of a weight lifting barbell during the performance of the front squat exercise is provided which transfers a majority of the load of the barbell to the anterior deltoid muscle areas of the weight lifter. The weight lifting device of the present invention comprises a pair of barbell supports, each having a lower surface contoured to fit and conform to the anterior deltoid muscle areas of the weight lifter and an upper surface for attaching to the shaft of a barbell. The method of performing the front squat exercise in which the weight lifter's legs are used to alternately raise and lower the upper portion of the body while maintaining the spine in an erect position comprises the steps of supporting the shaft of the barbell laterally above the clavicle and in front of the throat of the weight lifter using a weight lifting device for distributing a majority of the load of the barbell along the deltoid muscle areas of the weight lifter.

20 Claims, 5 Drawing Sheets

METHOD AND DEVICE FOR DISTRIBUTING THE LOAD OF A WEIGHT LIFTING BARBELL DURING THE PERFORMANCE OF THE FRONT SQUAT EXERCISE

This application claims benefit of Provisional Application Serial No. 60/068,292 filed Dec. 19, 1997.

BACKGROUND OF THE INVENTION

This invention relates to a method of performing the front squat exercise and a weight lifting device for supporting a weight lifting barbell during the performance of the front squat exercise, and more particularly, to a method of performing the front squat exercise and a weight lifting device for distributing the load of a weight lifting barbell to the anterior deltoid muscles of the weight lifter during the performance of the front squat exercise.

The front squat exercise in which the weight lifter's legs are used to alternately raise and lower the upper portion of the body while maintaining the spine in an erect position is one of the most beneficial exercises to develop lower body strength by increasing overall hip and leg strength as well as increasing hip flexibility. This exercise movement also produces a whole body training effect because it recruits more of the postural stabilizing musculature than many other weight bearing exercises. Typically, in performing the front squat exercise, the barbell shaft is positioned along the anterior deltoid close to the weight lifter's throat in the groove formed between the clavicle and the neck. This position of the barbell is necessary for the proper performance of the exercise because it places the load near the lateral mid-line of the body thereby allowing the weight lifter's posture to remain relatively erect and maintains the barbell above the hips so the load can be distributed to the large muscle groups in the legs and hips. Unfortunately, however, this position may also result in intense pain, discomfort, and tissue trauma to the weight lifter due to the shearing line of force exiting the relatively narrow metallic bar. Further, the position may also causes tremendous pressure to be applied to the sternum which may impede the natural rise of the weight lifter's chest cavity during the deep breathing cycle for performing the front squat exercise.

In order to maintain the barbell in its proper position during performance of the front squat exercise, various bar grips have been developed. The two most common bar grips utilized for performing the front squat are the "conventional" grip and the "cross-arm" grip. When using the "conventional" grip, the weight lifter rotates the hands and elbows and places his hands on the barbell such that it will rest in the last two knuckles of the fingers with the palms facing upward, the wrists cocked backwards in hyperextension, and the elbows pointing in a forward direction. When using the "cross-arm" grip, the weight lifter crosses his arms with his right and left hands on the opposite sides of his head just inside the shoulders with the thumbs sometimes hooked under the barbell. Unfortunately, however, while the "cross-arm" grip decreases the tendency for wrist injury, it also decreases the weight lifters lateral balance which may cause the barbell to see-saw.

Another common problem in performing the front squat exercise results when the weight lifter positions the barbell too high on the chest such that the bar bell presses on the weight lifter's throat which may result in limiting the weight lifter's air intake and may cause sever discomfort and injury.

Accordingly, a need exists for a weight lifting device for use in performing the front squat exercise which properly positions the barbell near the lateral mid-line of the body while distributing the load generally along the weight lifter's anterior deltoid muscles and which prevents or hinders the barbell from pressing against the weight lifter's throat or rolling down the arms and chest. There is also a commercial need to accommodate the vast differences between the various human forms in the shoulder anatomy and provide a device which fits many different shaped and sized people.

SUMMARY OF THE INVENTION

A method of performing the front squat exercise and a weight lifting device for distributing the load of a weight lifting barbell during the performance of the front squat exercise is provided which transfers and distributes a majority of the load of the barbell to the deltoid muscle areas of the weight lifter.

The weight lifting device of the present invention comprises a pair of barbell supports, each having a lower surface contoured to fit and conform to the right and left anterior deltoid muscle areas of the weight lifter and an upper surface having means for is attaching to the shaft of a barbell.

In a preferred embodiment of the invention, the means for attaching each barbell support to the shaft of the barbell comprises a pair of upwardly projecting bosses and a coaxial relatively cylindrically channel for receiving the shaft of the barbell. Preferably, the weight lifting device is formed by injection molding using a resilient plastic material having sufficient resiliency to permit the bosses to be removably snapped to secure the barbell shaft within the cylindrical channel.

In another preferred embodiment of the weight lifting device of the present invention, the resilient plastic material is a polyurethane.

In another preferred embodiment of the weight lifting device of the present invention, the resilient plastic material is a polyethylene.

In another preferred embodiment of the weight lifting device of the present invention, the resilient plastic material is a polyvinyl chloride.

In another preferred embodiment of the weight lifting device of the present invention, the resilient plastic material is a thermoplastic olefin.

In another preferred embodiment of the invention, the means for attaching each barbell support to the shaft of the barbell comprises a relatively thin flexible strip secured to the barbell support and adapted to wrap over the shaft of the barbell.

The method of performing the front squat exercise in which the weight lifter's legs are used to alternately raise and lower the upper portion of the body while maintaining the spine in an erect position comprises the steps of supporting the shaft of the barbell laterally above the clavicle and in front of the throat of the weight lifter using a weight lifting device comprising a pair of barbell supports. Each barbell support includes an upper surface having means for attaching the barbell support to the shaft of the barbell and a lower surface contoured to conform generally to the weight lifter's anterior deltoid muscle areas.

The primary object of this invention, therefore, is to provide a weight lifting device for supporting a barbell during the performance of the front squat exercise.

Another primary object of this invention is to provide a weight lifting device for transferring and distributing a majority of the load of the barbell primarily to the deltoid muscles of the weight lifter during the performance of the front squat exercise.

Another primary object of this invention is to provide a weight lifting device for minimizing the risk of a weight lifter experiencing tissue crush trauma during the performance of the front squat exercise.

Another primary object of this invention is to provide a weight lifting device and a method for supporting the shaft of the barbell in the proper position for performance of the front squat exercise.

Another primary object of this invention is to provide a weight lifting device and a method for supporting a barbell in a position that does limit the weight lifter's air intake during the performance of the front squat exercise.

Another primary object of this invention is to provide a weight lifting device and a method for supporting a barbell in a position that hinders or prevents injury to the weight lifter's throat and windpipe during the performance of the front squat exercise.

Another primary object of this invention is to provide a weight lifting device and a method of supporting a barbell in a position that hinders or prevents the weight lifter from experiencing loaded wrist hypertension during the performance of the front squat exercise.

Another primary object of this invention is to provide a weight lifting device and a method for supporting a barbell in a position that hinders or prevents the weight lifter from experiencing extreme rotation of the humerus during the performance of the front squat exercise.

Another primary object of this invention is to provide a weight lifting device for supporting a barbell during the performance of the front squat exercise which is relatively inexpensive to manufacture.

Another primary object of this invention is to provide a weight lifting device for supporting a barbell during the performance of the front squat exercise that may be used by various individuals each being of different size and body build.

Other objects and advantages of the invention will be apparent from the following description, the accompanying drawings and the appended claims.

DESCRIPTION OF THE PREFERRED EMBODIMENT

Figure 1:
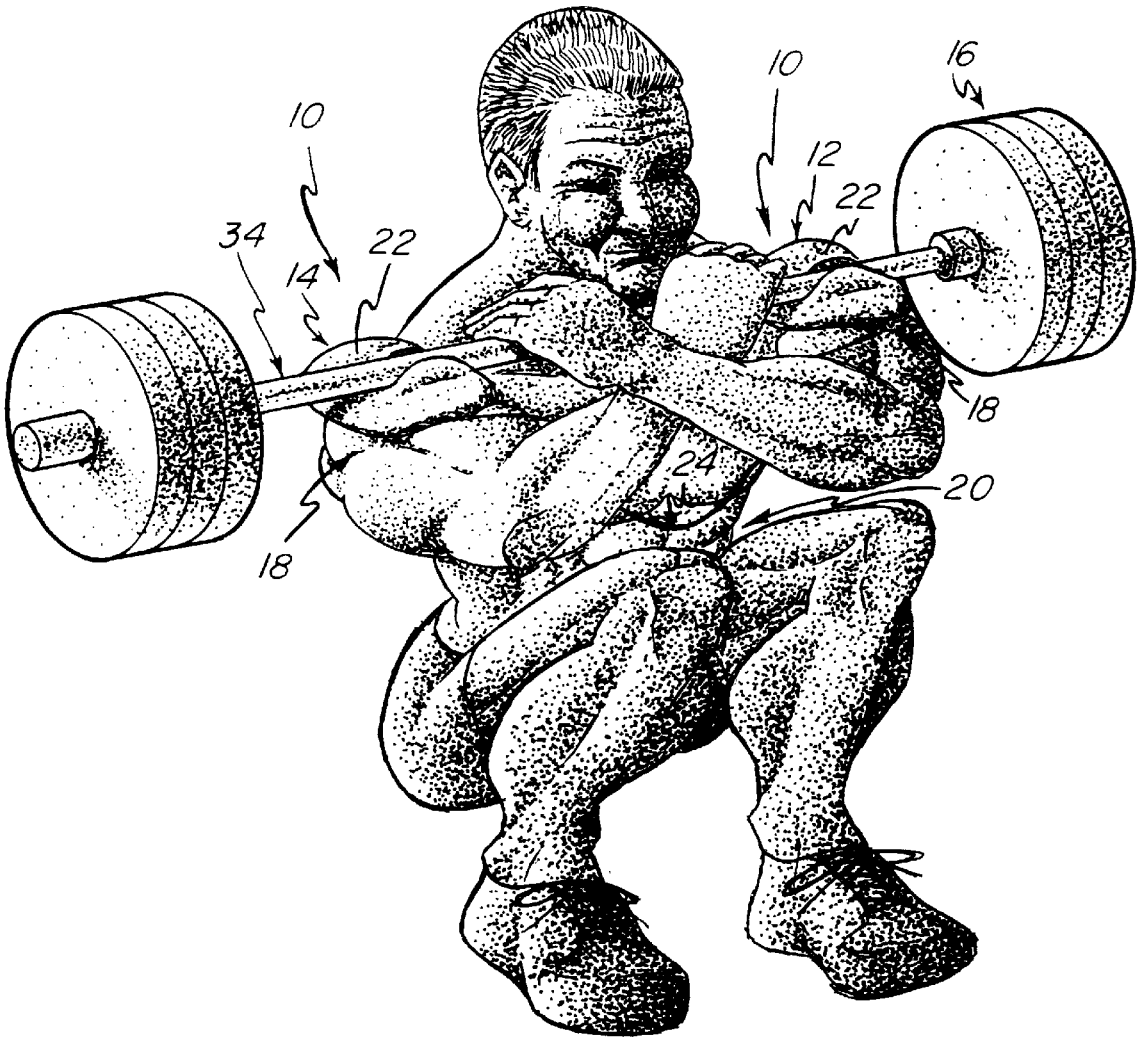
FIG. 1 is a perspective view of the weight lifting device of the present invention having a pair of barbell supports positioned on a weight lifter for performing front squat exercises.

Referring to FIG. 1, the weight lifting device of the present invention, generally designated 10, is shown comprising a pair of barbell supports, designated 12 and 14, which function to transfer and distribute a majority of the load of the barbell 16 primarily over the anterior deltoid muscle areas 18 while at the same time protects the throat area of the weight lifter 20 during the performance of the front squat exercise. As used herein, the terms "front" and "back" correspond to the front and back of a person such as a weight lifter and a "lateral direction" is across the body from side to side. "Inner" or "inwardly" refers to the direction facing the body of the weight lifter and "outer" or "outwardly" refers to the direction facing away from the body.

Figure 2:
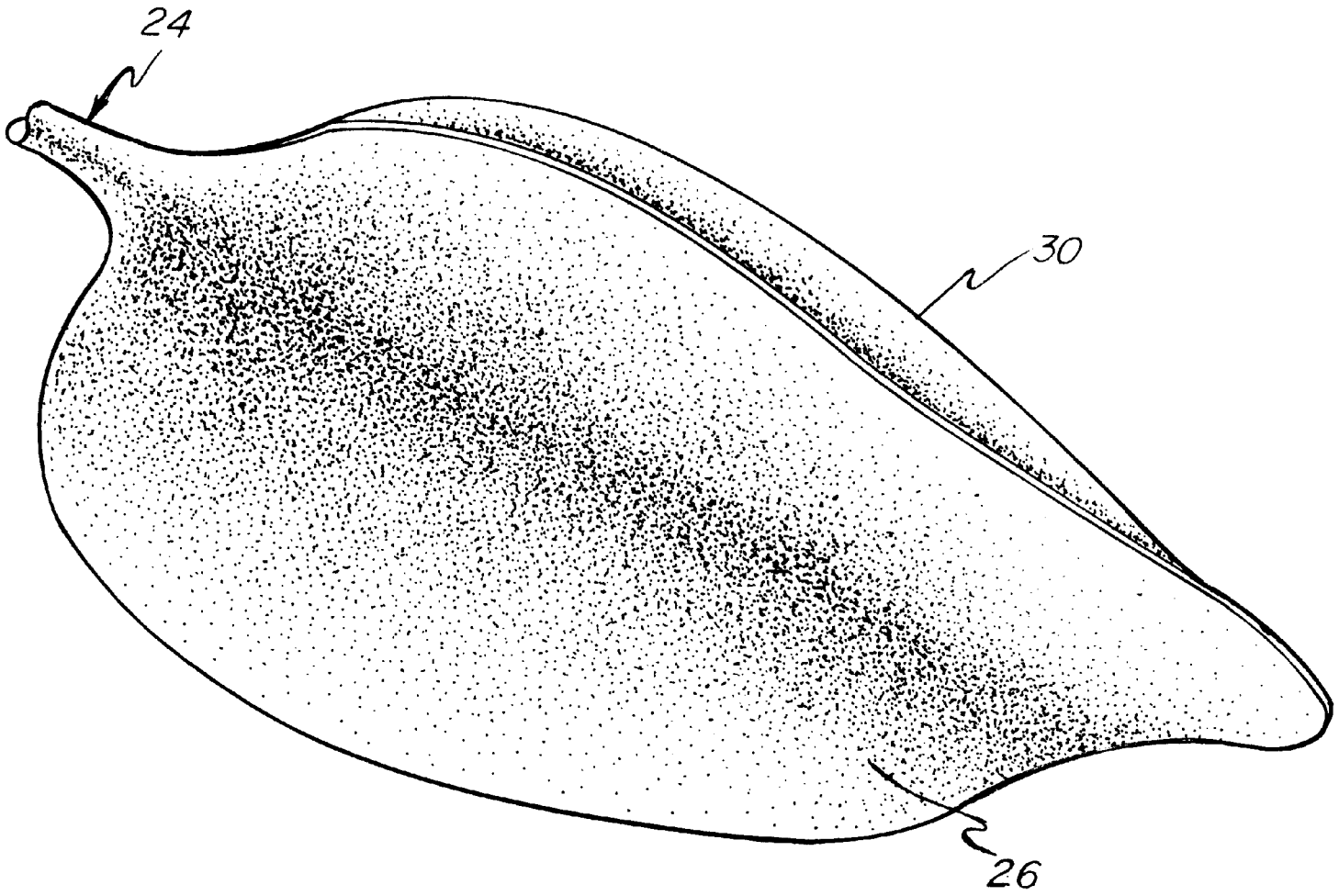
FIG. 2 is a perspective bottom view of a barbell support of the weight lifting device of the present invention.

The barbell supports 12 and 14 of the weight lifting device 10 each have a generally oval shaped body 22 connected together by a suitable flexible cord 24. As shown in FIGS. 1, and 2, the lower surfaces 26 of the barbell supports 12 and 14 are inwardly convex to fit and conform generally to the right and left anterior deltoid muscle areas 18 and 19, respectively, of the weight lifter 20. The shape and contour of the lower surfaces 26 (FIG. 2) permits the load of the barbell 16 to be distributed primarily across the anterior deltoid muscle areas 18 while placing and maintaining the load of the barbell near the lateral midline of the body.

Figure 3:
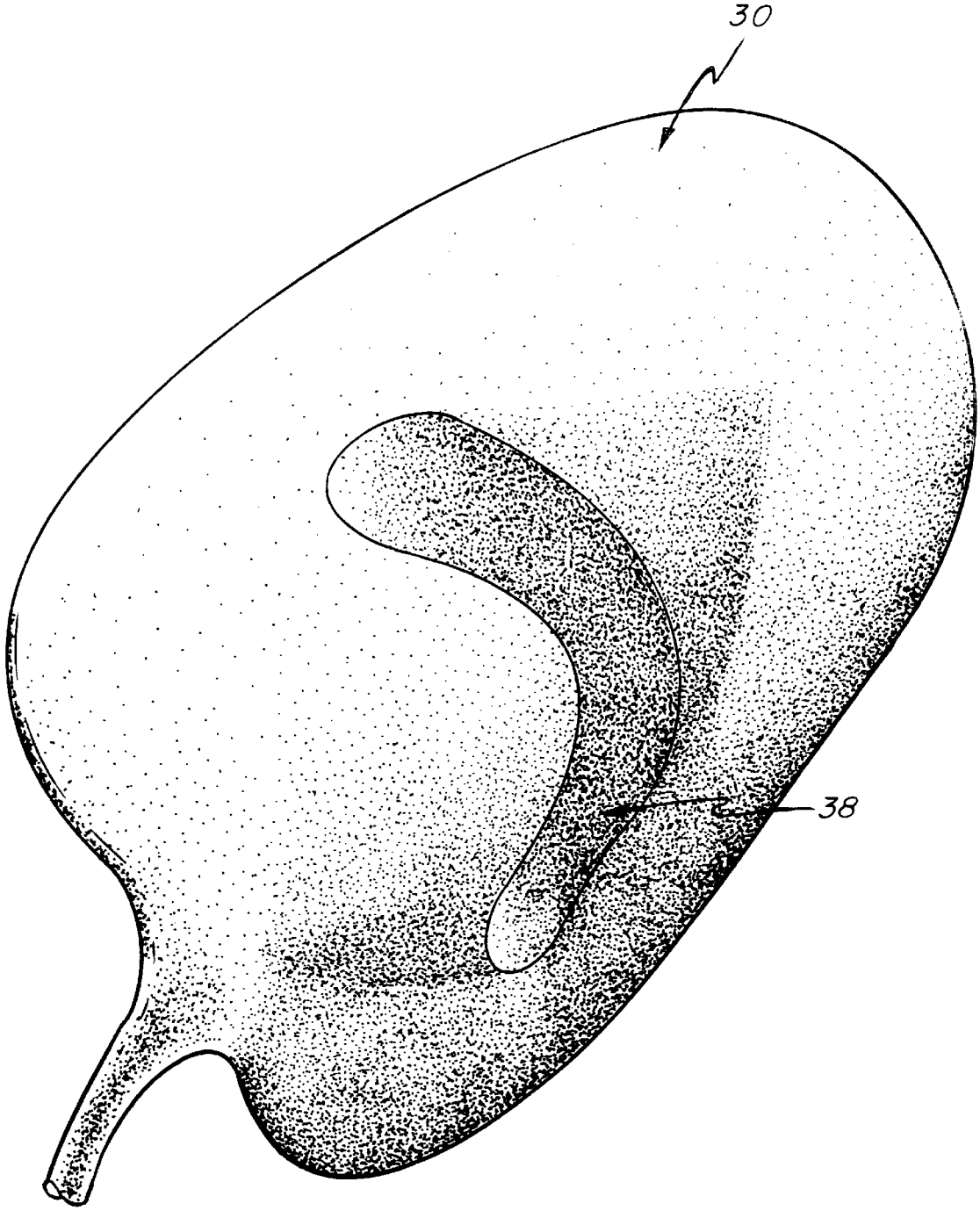
FIG. 3 is a perspective top view of a barbell support of the weight lifting device of the present invention.
Figure 4:
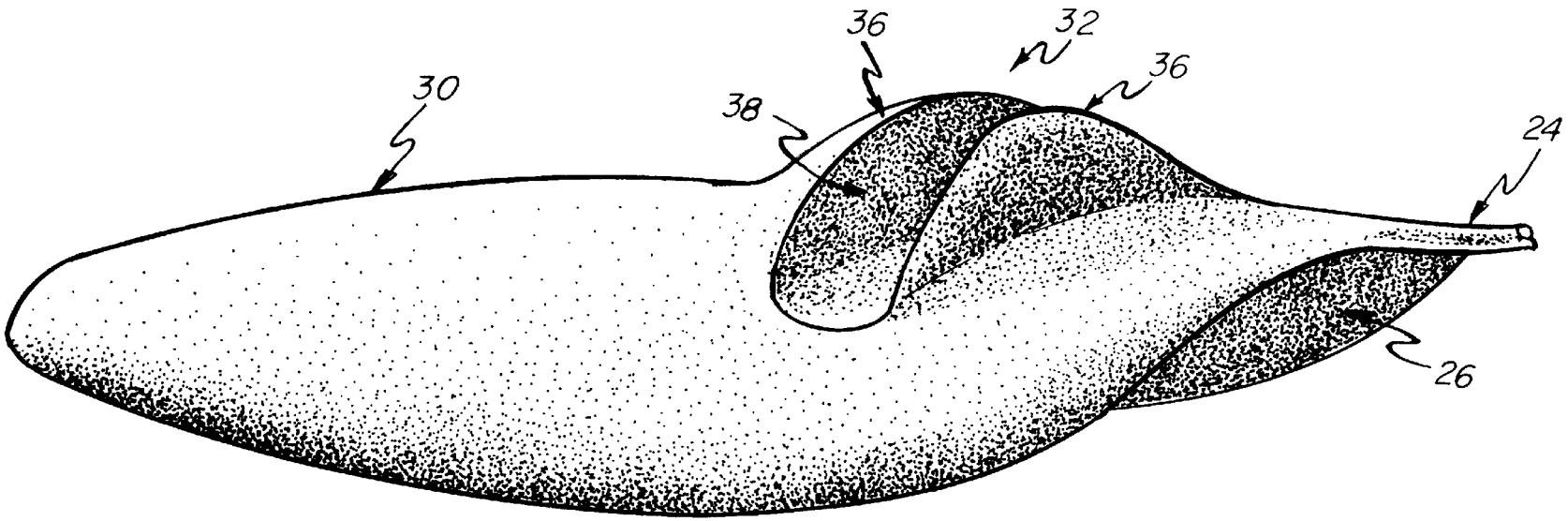
FIG. 4 is a perspective side view of a barbell support of the weight lifting device of the present invention.

The upper surfaces 30 of the barbell supports 12 and 14, each include means 32 for attaching the barbell support to the shaft 34 of the barbell 16. In a preferred embodiment of the invention, as shown in FIGS. 3 and 4, the means 32 for attaching the barbell support 12, 14 to the shaft 34 of the barbell 16 comprises a pair of upwardly projecting bosses 36 that are provided with a coaxial, generally cylindrical, sectored channel 38 for receiving the shaft 34. In order to removably snap the barbell supports 12 and 14 to the shaft 34 of the barbell 16, the channels 38 have a diameter that is slightly less than the diameter of the shaft 34 of the barbell 16 and extend circumferentially slightly more than 180 degrees. This permits each support 12 and 14 of the weight lifting device 10 to be removably attached and secured in place along the shaft 34 of the barbell 16.

Preferably, the weight lifting device is formed by injection molding using a resilient plastic material, such as a polyurethane, a polyethylene, a polyvinyl chloride, or a thermoplastic olefin, which can be formed into general conformity with the anterior deltoid areas and which has sufficient strength to support the load of the barbell and the resiliency to permit the bosses to be removably snapped to secure the barbell shaft within the cylindrical channel. The flexible cord 24 may be formed from the same resilient plastic material as the barbell supports 12 and 14 or may be formed of a conventional cord material.

Figure 5:
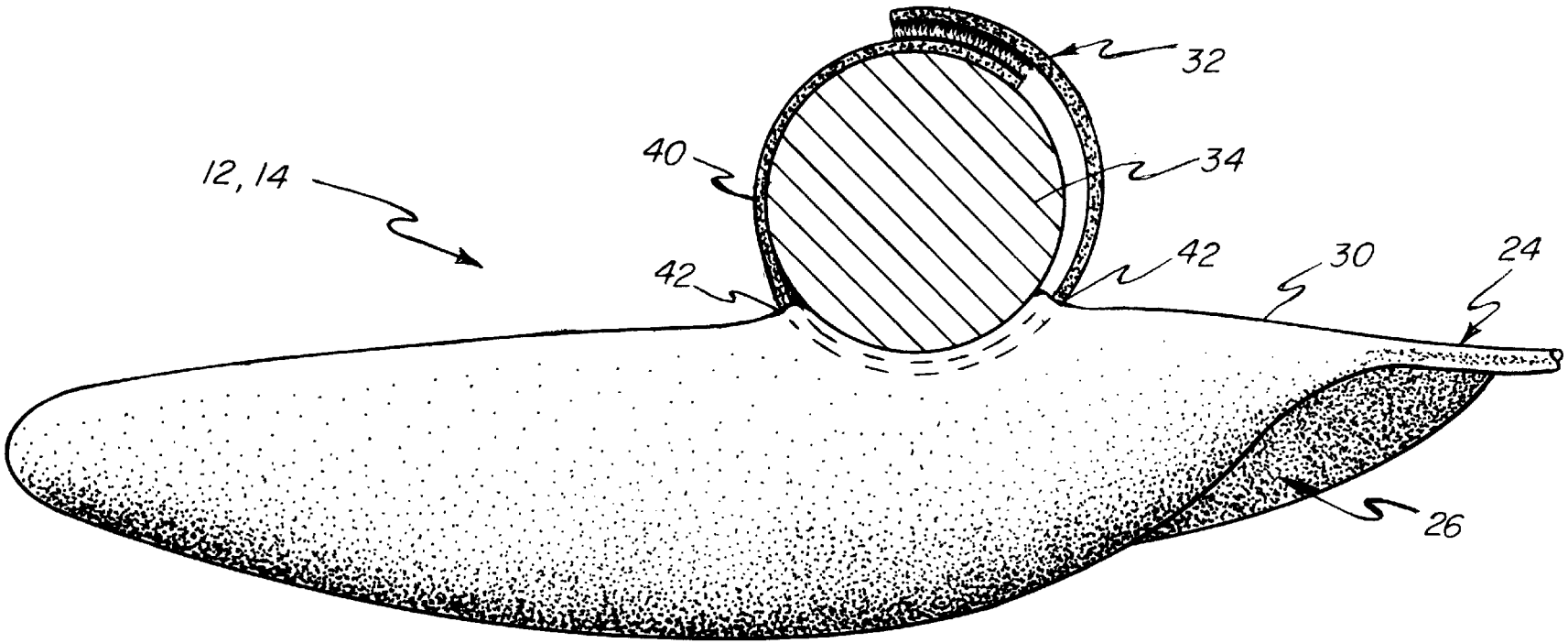
FIG. 5 is a side view of a support of a second embodiment of the weight lifting device of the present invention showing a barbell support having a flexible strip adapted to wrap over the shaft of the barbell.

Referring to FIG. 5, a second embodiment of the present invention is shown whereby the means 32 for attaching each of the barbell supports 12 and 14 to the shaft 34 of the barbell 16 comprises a pair of relatively thin flexible strips 40 passing through slots 42 in the upper surface 30 of each barbell support. The flexible strips 40 are each adapted to wrap over the shaft 34 of the barbell 16 (FIG. 1) and are provided with one surface having a plurality of minute loops of synthetic resin to engage a second surface having a plurality of minute hooks of synthetic resin. Such flexible strips are made by the American Velcro Company and sold under the trademark "VELCRO." It should be apparent now to one skilled in the art that other means for securing the shaft of the barbell to the weight lifting device of the present invention, such as for example various types of adhesives, tapes, buckles, or clamps, may also be utilized.

In performing the front squat exercise, as shown in FIG. 1, the weight lifter attaches and secures the barbell supports of the weight lifting device onto the shaft of a conventional barbell having various conventional weights on each of its opposite ends. Because of the vast differences between the various human forms in the shoulder anatomy and the many different shapes and sizes of people, the supports are spaced laterally apart along the shaft such that when the barbell is lifted into position the barbell supports rest on the anterior deltoid muscle areas of the weight lifter and supports the shaft laterally above the weight lifter's clavicle and in front of the throat. The weight lifter's legs are then used to alternately raise and lower the upper portion of the body while maintaining the spine in a generally erect position.

It should now be apparent to one skilled in the art that the method of performing the front squat exercise and the weight lifting device of the present invention has numerous benefits. One benefit of the present invention is that essentially the majority of the load of the barbell is transferred and distributed across the anterior deltoid muscle areas of the weight lifter. Another benefit of the present invention is that the barbell is supported in the proper position above the hips for optimal biomechanical performance of the front squat exercise. Another benefit of the present invention is that the weight lifting device sufficiently elevates the shaft to bridge the clavicle of the weight lifter and is prevented from contacting the throat or from rolling or sliding downwardly thereby reducing or preventing injury or intense pain or discomfort to the weight lifter or hinder or limit the weight lifter's air intake. Another benefit of the present invention is that the shaft of the barbell is prevented from rolling or sliding downwardly over the chest thereby maintaining the barbell in the proper position near the lateral mid-line of the weight lifter thereby allowing the weight lifter's posture to remain relatively erect and for reducing the tendency of wrist and lower back discomfort or injury . Another benefit of the present invention is the barbell is prevented from sea-sawing and reduces the need for the weight lifter to control the bar with the hands. This is particularly beneficial for weight lifters having past or present wrist injury.

It should also now be apparent to one skilled in the art that the weight lifting device of the present invention is designed to be compatible with most human forms making it possible for the device to be made in one size. This makes it possible to keep tooling and manufacturing costs to be relatively low. It also permits two or more people who exercise together to share one device.

While the preferred embodiment of the present invention has been described fully in order to explain its principles, it is understood that various modifications or alterations may be made to the preferred embodiment without departing from the scope of the invention as set forth in the appended claims. The invention is, therefore, claimed in any of its forms or modifications within the proper scope of the appended claims appropriately interpreted in accordance with the doctrine of equivalents.

I claim:

1. A weight lifting device for supporting the shaft of a barbell in the proper position for performance of the front squat exercise by a weight lifter, the weight lifting device comprising:

a pair of supports, each support having an upper surface comprising means for supporting the shaft of the barbell laterally in front of the throat of the weight lifter and for preventing the shaft of the barbell from contacting the throat or from rolling downwardly over the chest of the weight lifter, and a lower surface comprising means for transferring and distributing a majority of the load of the barbell to the anterior deltoid muscle areas of the weight lifter and being contoured to fit the anterior deltoid muscle areas.

2. The weight lifting device of claim 1 wherein said weight lifting device comprises means for attaching to the shaft of the barbell.

3. The weight lifting device of claim 1 wherein said means for transferring and distributing a majority of the load of the barbell to the deltoid muscle areas of the weight lifter comprises a pair of supports, each support having an upper surface for attaching to the shaft of the barbell and a lower surface contoured for transferring and distributing a majority of the load of the barbell across the anterior deltoid muscle areas of the weight lifter.

4. The weight lifting device of claim 1 wherein said device is formed from a resilient plastic material.

5. The weight lifting device of claim 1 wherein said resilient plastic material is selected from the group consisting of a polyurethane, a polyethylene, a polyvinyl chloride, and a thermoplastic olefin.

6. A weight lifting device for supporting the shaft of a barbell in the proper position for performance of the front squat exercise by a weight lifter, the weight lifting device comprising:

a pair of barbell supports for supporting the shaft of the barbell laterally above the clavicle and in front of the throat of the weight lifter and for preventing the shaft of the barbell from contacting the throat or from rolling downwardly over the chest of the weight lifter;

wherein said barbell supports each have a lower surface contoured to conform to the anterior deltoid muscle areas of the weight lifter; and wherein said barbell supports each have a means for securing the weight lifting device on the shaft of the barbell.

7. The weight lifting device of claim 6 wherein said lower surface of said barbell supports are inwardly convex to fit and conform to the anterior deltoid muscle areas of the weight lifter.

8. The weight lifting device of claim 6 wherein said means for securing the weight lifting device on the shaft of the barbell comprise a means for removably attaching said barbell supports to the shaft of the barbell.

9. The weight lifting device of claim 8 wherein said means for securing the weight lifting device on the shaft of the barbell comprises a pair of oppositely disposed bosses having coaxial, generally cylindrical, sectored channels for receiving the shaft of the barbell.

10. The weight lifting device of claim 8 wherein said means for securing the weight lifting device on the shaft of the barbell comprises a relatively thin flexible strip secured to the barbell support and adapted to wrap over the shaft of the barbell.

11. The weight lifting device of claim 6 wherein said device is formed from a resilient plastic material.

12. The weight lifting device of claim 6 said resilient plastic material is selected from the group consisting of a polyurethane, a polyethylene, a polyvinyl chloride, and a thermoplastic olefin.

13. The weight lifting device of claim 6 wherein said means for securing the weight lifting device on the shaft of the barbell comprises a pair of upwardly projecting bosses having a coaxial, generally cylindrical, sectored channels for receiving the shaft of the barbell.

14. The weight lifting device of claim 13 wherein said channel for receiving the shaft of the barbell has a diameter that is slightly less than the diameter of the shaft of the barbell and extending circumferentially slightly more than 180 degrees to permit said weight lifting device to be removably secured in place on the shaft of the barbell.

15. The weight lifting device of claim 6 wherein said supports are connected together by a flexible cord.

16. A method of performing the front squat exercise in which the weight lifter's legs are used to alternately raise and lower the upper portion of the body while maintaining the spine in an erect position comprising the steps of:

supporting the shaft of the barbell laterally above the clavicle and in front of the throat of the weight lifter using a weight lifting device;

wherein the weight lifting device comprises a pair of supports, each support having a lower surface which is contoured to fit the anterior deltoid muscle area so as to transfer and distribute a majority of the load of the barbell to the anterior deltoid muscle area of the weight lifter and each support further has means to prevent the shaft of the barbell from contacting the throat or from rolling downwardly over the chest of the weight lifter.

17. The method of performing the front squat exercise of claim 16 wherein the weight lifting device comprises a support having a lower surface contoured for distributing the load of the barbell across the anterior deltoid muscle areas of the weight lifter.

18. The method of performing the front squat exercise of claim 16 wherein the weight lifting device comprises means for attaching the device to the shaft of the barbell.

19. The method of performing the front squat exercise of claim 16 wherein the weight lifting device comprises a pair of supports, each support having an upper surface for attaching to the shaft of the barbell and a lower surface for transferring and distributing a majority of the load of the barbell across the anterior deltoid muscle areas of the weight lifter.

20. The method of performing the front squat exercise of claim 16 further comprising the step of:

alternately raising and lowering the upper portion of the body of the weight lifter while maintaining the spine in a generally erect position.

* * * * *